United States Patent [19]

Siebert

[11] Patent Number: 5,068,969

[45] Date of Patent: Dec. 3, 1991

[54] LIGHTED GUN SIGHT

[76] Inventor: Robert M. Siebert, 1813 Yale, Ponca City, Okla. 74604

[21] Appl. No.: 506,084

[22] Filed: Apr. 9, 1990

[51] Int. Cl.[5] ..... F41G 1/32

[52] U.S. Cl. ..... 33/241; 42/103; 362/110

[58] Field of Search ..... 33/241; 362/110, 111, 362/113, 114; 42/90, 103, 106

[56] References Cited

U.S. PATENT DOCUMENTS

| | | | |
|---|---|---|---|
| 1,083,073 | 12/1913 | Ferguson et al. | 362/114 |
| 1,149,705 | 8/1915 | Ward | 42/103 |
| 2,894,117 | 7/1959 | Hoskey | 362/111 |
| 3,320,671 | 5/1967 | Rickert et al. | 33/241 |
| 3,914,873 | 10/1975 | Elliott, Jr. et al. | 42/103 |
| 3,963,356 | 6/1976 | Wiklund | 33/241 |
| 3,994,072 | 11/1976 | Agnello, Jr. | 33/241 |
| 4,161,076 | 7/1979 | Snyder | 42/1 A |
| 4,298,914 | 11/1981 | Long | 362/112 |
| 4,665,622 | 5/1987 | Idan | 33/241 |
| 4,713,889 | 12/1987 | Santiago | 33/241 |
| 4,936,037 | 6/1990 | Holcomb | 340/539 |
| 4,945,667 | 8/1990 | Rogalski et al. | 42/103 |

FOREIGN PATENT DOCUMENTS

| | | | |
|---|---|---|---|
| 252523 | 3/1912 | Fed. Rep. of Germany | 362/113 |
| 2230957 | 12/1974 | France | 362/110 |
| 5029 | 1/1913 | United Kingdom | 362/114 |

OTHER PUBLICATIONS

"The Colt 0.45 Automatic" (a shop manual) by Jerry Kuhnhansen, VSP Publishers, P.O. Box 1966, Tustin, Calif., 92681.

"Hallock's 0.45 Auto Handbook" by Ken Hallock, pub. 1980.

*Primary Examiner*—Thomas B. Will

[57] ABSTRACT

A lighted gun sight is mounted on the slide of a semi-automatic pistol which reloads by having the slide move rearwardly for ejecting the used cartridge and inserting a new cartridge. The semi-automatic pistol has a grip attached to its lower portion with a trigger for firing the pistol and a grip safety which is attached to the rearward portion of the grip so that the gun cannot be fired without the grip being squeezed. The lighted gun sight essentially comprises a power source, a switch, and an intensity control apparatus mounted in the grip of the pistol. A bridge is then mounted on the slide from the gun sight to the grip. An electrical power coupling apparatus is provided between the grip and the bridge in a manner so that power can be coupled to the gun sight when the gun is ready for firing and may be decoupled when the pistol has been fired.

15 Claims, 3 Drawing Sheets

LIGHTED GUN SIGHT

A BRIEF DESCRIPTION OF THE PRIOR ART

Lighted gun sights for pistols are generally old, that is, gun sights either for generating a lighted signal utilizing a laser or a light emitting diode (LED) which reflects off a selective mirror are old. This invention basically relates to the latter type of sight which incorporates such an apparatus on a gun sight without requiring an unwieldy bracket for holding the lighted apparatus. U.S. Pat. No. 4,161,076 is illustrative of the mounting utilized for lighted gun sights where the bracket is attached to the side of the pistol and the sighting apparatus is attached to the bracket so that it can be positioned along the sighting axis of the pistol U.S. Pat. No. 4,298,914 is illustrative of a system for generating power which is mounted in the handle of a pistol. Such a light, however, would be not useful in the invention disclosed herein.

BRIEF DESCRIPTION OF THE INVENTION

This invention basically relates to a lighted gun sight, that is, a gun sight which utilizes an LED as the rear sight and a light selective mirror as the front sight. The sighting is generally accomplished by illuminating the LED and then viewing the lighted LED in the front gun sight. The front gun is basically a glass which reflects the red color of the LED but permits all other light to pass through the glass. When the gun is positioned for firing the target can be viewed through the front gun sight and the LED is reflected, thus giving the position of the rear sight with respect to the target.

One of the problems in the past has been the unwieldy bracket apparatus used to hold the lighted gun sight, which comprised both the rear sight with the LED and the light reflective glass for the front sight. Such sighting apparatus substantially increases the weight of the pistol for the gun operator.

The subject matter of this invention, on the other hand, adds little weight to the semi-automatic pistol and yet provides a lighted gun sight similar to that disclosed above. The invention is accomplished by providing a thin board which can be incorporated under the grip of the pistol. The board essentially contains a switch for activating or deactivating a battery which is also contained on the board and a illumination control apparatus likewise mounted on the board. In the preferred embodiment the safety grip is utilized to activate the switch so that when the gun is not in the hand of a person utilizing the weapon, the light will not be activated, but once the grip is squeezed the grip safety means will actuate a switch which will turn on the LED so that LED will be illuminated in the front reflective glass sight. Such a switch not only provides both extended battery life but also leaves the shooter free to aim the weapon rather than initiating the lighting process by hand-actuating the switch or the light. One of the problems with a semi-automatic weapon is that the portion containing the rear sight is mounted on a slide which is actuated rearwardly each time the gun is fired. As the slide moves rearward the spent bullet casing is ejected and a new cartridge is inserted into the firing chamber from a clip in the grip of the pistol. The slide then moves forward and locks and is then ready for the next firing of the semi-automatic weapon. The sliding action, however, makes it impossible, in the prior art, to couple power from the lighted gun sight on to the rear sight. This problem is overcome in this invention by providing a sliding contact which has one portion attached to the grip and the second portion attached to a bridge which couples the sliding contact to the lighted portion of the rear sight.

Another feature of this invention is the novel apparatus for mounting the LED, which essentially comprises a housing having a longitudinal bore with an LED mounted in the longitudinal bore. A pair of contacts are provided to the bracket which has the leads of the LED attached thereto. The contacts then are inserted into mating contacts in the rear sight bridge which makes electrical contact with the power source. The LED is novel in that it is formed by milling the front of the LED to a flat surface and then mounting thereon various types of masks so that the LED can be made to accommodate any type of pattern which the operator desires to be displayed on the front reflective glass. The mounting containing the LED can be replaced or exchanged with other configurations for the LED masks.

BRIEF DESCRIPTION OF THE DRAWINGS

Referring to FIG. 1, a semi-automatic pistol is generally referred to by arrow 10 which has a slide 11, a front sight 12, a rear sight referred to by arrow 13, a cocking apparatus 14, a trigger guard 15, and a trigger 16, mounted therein.

Figure 1:
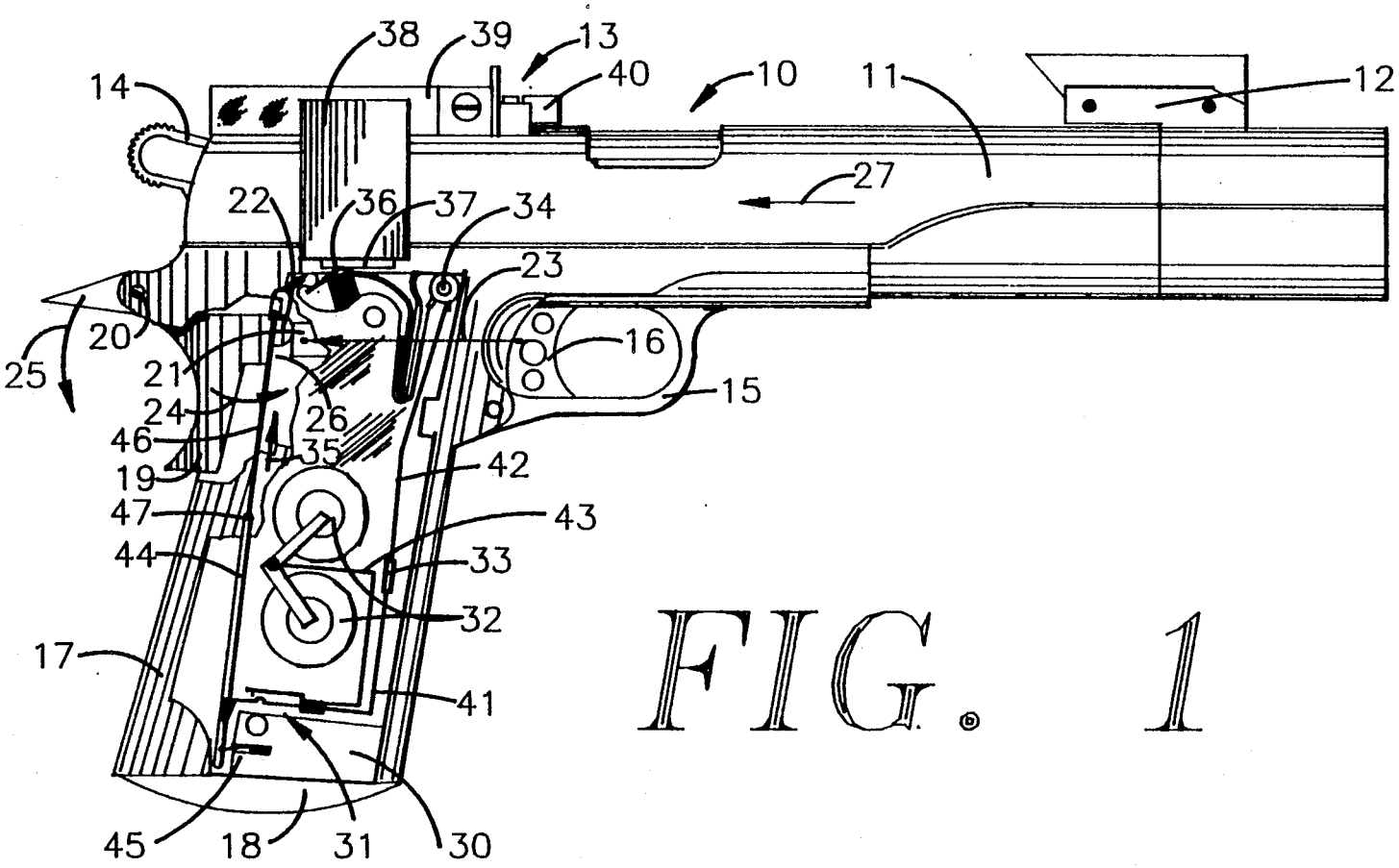
FIG. 1 illustrates a semi-automatic weapon having portion cut away in order to better illustrate the operation of the grip, the trigger, and the mounting of the light power source.

A grip, 17, has a location, 18, for inserting clips (not shown) into the pistol 10 for semi-automatic firing. In grip 17 is formed a grip safety apparatus 19 which is attached to grip 17 by a pivot 20. Trigger 16 has an extension 21 which butts up against an extension 22 mounted to grip safety apparatus 19. Extension 22 blocks trigger 16 from moving rearward in the direction of arrow 23 unless grip safety means 19 is depressed in the direction of arrows 24 and 25 causing extension 22 to move upwardly thereby allowing trigger extension portion 21 to move into slot 26. Before pistol 10 can be fired, grip safety apparatus 19 must be grasped and forced in by the squeezing of the fingers and palm against safety grip apparatus 19. Once this is accomplished then trigger 16 can move back as previously described into slot 26, allowing the gun to be fired.

The invention is incorporated by mounting a board 30 underneath the grip cover (not shown) and against grip 17. All of the elements on board 30 are sufficiently small and compact so that the grip cover can easily surround and cover the board. Mounted in the board are the necessary elements to light rear sight 13. These elements essentially comprise a grip safety apparatus actuated switch 31, a pair of batteries 32, a current limiting resister 33, an adjustable rheostat 34 for adjusting the intensity of the LED to be later described, a spring contact 36, and a mating sliding contact 37 which is attached to a bridge 38. Bridge 38 is mechanically coupled to a portion 39 of rear sight 13 which in turn has LED mounting brackets 40 attached thereto. LED bracket 40 obviously can be attached to slide 11 itself, however, electrical means must be attached to the LED mounting bracket 40 and electronically communicating with bridge 38 and to moving slide contact 37 as will be fully described in FIG. 2. A wire 41 is coupled to current limiting resister 33 and a wire 42 is coupled to rheostat 34. A wire 43 connects the positive poles of batteries 32 to switch 31. Switch 31 is actuated by a sliding bar 44 which is positioned in a slot (not shown) in board 30 and has a leaf spring 45 attached to board 30 in a manner to urge sliding bar 44 continuously downwardly so that the contact of switch 31 are always normally open. A bar 46 is coupled through an opening 47 in sliding bar 44 and hooks over grip safety apparatus 19 at its upper surface so that when grip safety apparatus 19 is moved in the direction of arrows 24 and 25 then bar 46 will move upwardly in the direction of arrow 35, moving the contacts of switch 31 together. Power will be then supplied to current limiting resister 33 and will pass through rheostat 34 to spring contact 36, across sliding contact 37 and subsequently to LED 60 causing it to illuminate.

Figures 2, 3, 4:
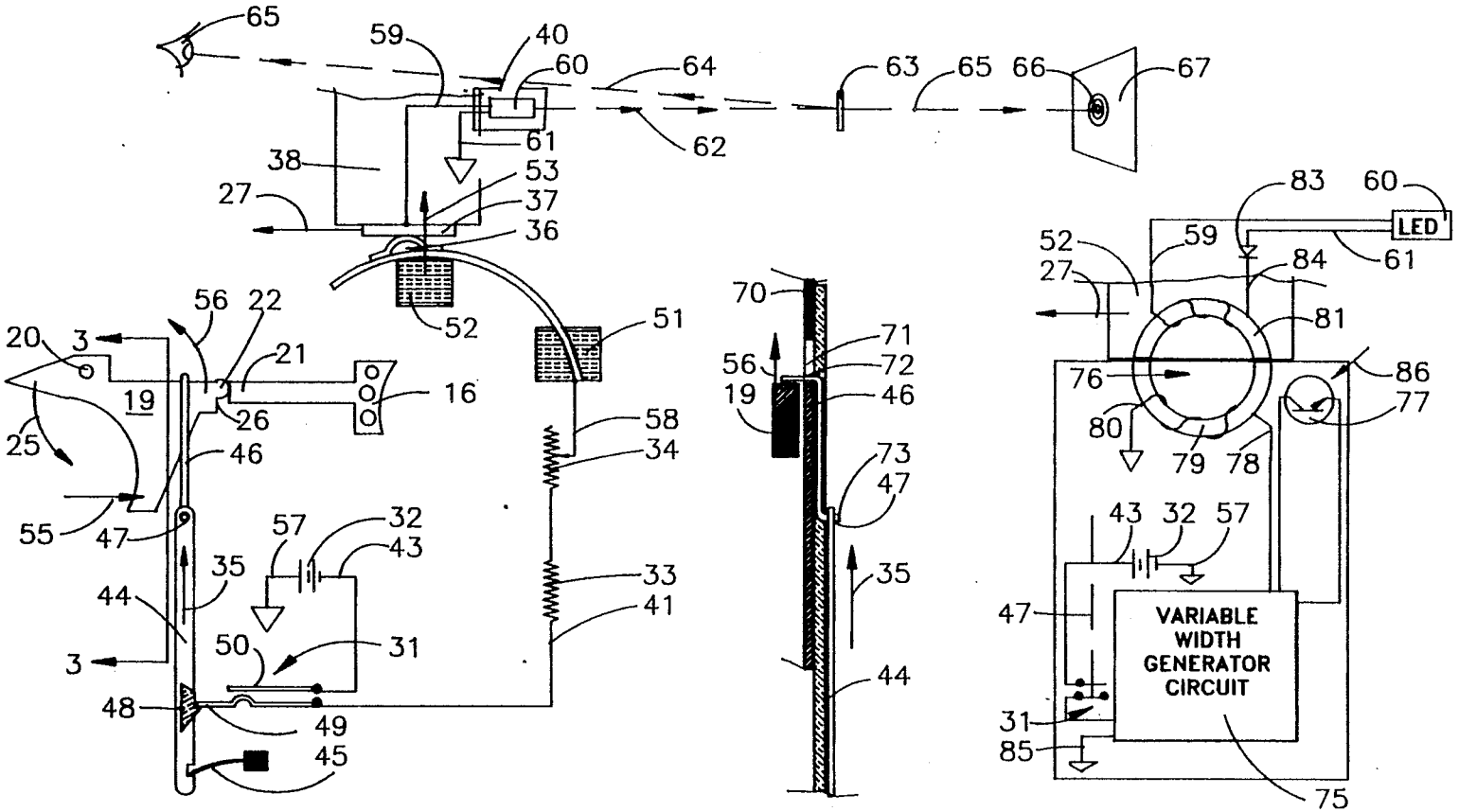
FIG. 2 is a schematic diagram illustrating the invention and its operation.
FIG. 3 is a side view taken along lines 3 of FIG. 2 illustrating the manner in which the switch is coupled to the grip safety apparatus; .
FIG. 4 shows an alternate method of coupling power from the grip to the bridge of the semi-automatic weapon lighting system.
Figure 6:
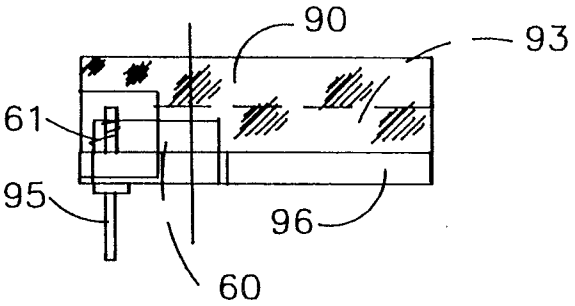
FIG. 6 is the side view of the apparatus illustrated in FIG. 5.

Referring to FIG. 2, a schematic diagram of the preferred embodiment is illustrated. In addition to those elements already described, sliding bar 44 has an insulated portion 48 coupled to one contact 49 of switch 31. A second contact 50 is connected to wire 43. Spring contact 36 is insulated and anchored at a location 51 and further has a spring type material 52 which will continually urge spring contact 36 upwardly in the direction of arrow 53. Material 52 can, for example, be a piece of rubber or a silicon material which is yieldable so that spring contact 36 will always be urged in the direction of arrow 53.

OPERATION

The operation of the apparatus illustrated in FIG. 2 is identical to that described in FIG. 1. However, when it is desired to shoot the weapon, pressure is applied in the direction of arrow 55 causing grip safety apparatus 19 to rotate about pivot 20 as indicated by arrow 25. The above causes extension 22 to rotate upwardly as shown by arrow 56 permitting trigger 16 to be pressed since extension 21 will now fall into slot 26. When this occurs, bar 46 which is lying on top of grip safety apparatus 19, will move upwardly where the portion of bar 46 is hooked into opening 47. Sliding bar 44 will move upwardly in direction of arrow 35. Insulated portion 48 will then cause contact 49 to move up into electrical contact with contact 50, closing switch 31. Power will then be applied to ground (the frame and the pistol 10) through wire 57 and through wire 43 through contact 50 to contact 49 which is now made, though wire 41, current limiting resistor 33 and to rheostat 34. Rheostat 34 then applies power through wire 58 to spring contact 36. Since the weapon has not been shot, sliding contact 37 will be in position above spring contact 36 therefore the electrical power is communicated to sliding contact 37 and through a wire 59 which is in bridge 38, to LED 60. LED 60 is then coupled back to ground through a wire 61 completing the circuit.

When the circuit is complete LED 60 will light, causing a red beam 62 to strike glass 63 which has previously been described as transparent to all colors but the color of the LED. Light from the LED then will be reflected along beam 64 to a viewer's eye 65. The viewer's eye will note the position of the red dot in the transparent glass and position the red dot along beam 65 to the center 66 of a target 67.

FIG. 3 is a side view taken through lines 3—3 of FIG. 2 of bar 46 and grip safety apparatus 19 that operates switch 31. An opening 71 is cut through the grip portion 70 of automatic pistol 10 in order to accommodate bar 46. Bar 46 has a bent over end 72 which lies on top of grip safety apparatus 19. Slot 71 is normally formed by drilling a pair of holes and cutting between the holes or by milling out the slot, or any other usual machining method. The slot 71 need be only slightly wider than the bar 46 and should permit free movement of bar 46 in a vertical direction. Bar 46 also has a second bent portion 73 which slips into hole 47 of sliding bar 44. Thus it can be illustrated that any movement of grip safety apparatus 19 upwardly in the direction of arrow 56 will cause a corresponding movement in sliding bar 46 as illustrated by arrow 35. In view of the above, switch 31 will only be actuated when the safety grip is pressed and safety grip 19 will only be pressed when a shooter is about to press trigger 16.

An alternate apparatus for transferring power from the grip to the bridge is illustrated in FIG. 4. FIG. 4 generally includes some of the same circuitry as illustrated in FIG. 2. As, for example, switch 31, bar 47 which is here illustrated as dotted lines, battery 32, grounding wire 57, and wire 43 which is coupled from battery 32 to switch 31. Rather than a resister 33 and rheostat 34, a variable width generator circuit 75 is illustrated. Such variable width generator circuits are well known in the art and basically delivers a DC voltage which has a pulse width determined by some external source. The wider the width of the pulse, the more power is delivered to a source such as a transformer referred to by arrow 76. Variable width circuit generator 75 can have its pulse width varied by either a potentiometer or rheostat 34 as illustrated in FIG. 2, or a transistor 77 which has its resistance determined by the quantity of light falling upon the transistor. Such transistors are very well known and are not a part of this invention. The transistor, however, is coupled to variable width generator circuit 75 and does control the width of the pulses being generated by circuit 75. Such pulses are then transferred through wire 78 to a primary wrapped around core 79 of transformer 76. The circuit is completed through a ground wire 80. Core 79 is ½ of the core of toroidial transformer 76. The other half 81 of core 79 of transformer 76 is mounted in bridge 52. Wires 59 are then coupled as previously described to LED 60. A remaining wire 61 is coupled to a diode 83 rather than to ground. Diode 83 is then coupled through a wire 84 to the secondary wrapped around core 81.

The circuit of FIG. 4 operates by the same method essentially as that described in FIG. 2, that is, the grip safety apparatus, when squeezed, moves bar upwardly so that switch 31 is closed. Power is transferred from battery 32 through wire 43 through switch 31 to variable width generator circuit 75. Variable width generator circuit 75 is then coupled through a wire 85 to ground. When grip safety apparatus 19 is squeezed, variable width generator circuit 75 will be turned on. The width of the pulse will be controlled by transistor 77 which will determine the width by the amount of light falling as a ray 86 on transistor 77. The light of the LED needs to be controlled in proportion to the amount of ambient light present. That is, the brighter the light, the brighter the LED needs to be. The variable width pulse is then transferred through wire 78 to the primary 8 transformer 76 which generates a magnetic flux in core 79. Since core 79 is a toroid, the other half 81 of toroidial transformer 76 generates a similar magnetic flux. Such flux will then induce a current into the secondary 8 transformers 76 causing current to pass through wire 59, LED 60, through wires 61 and diode 83 to wire 84. Diode 83 is used to convert the electricity from alternating current (since transformer 76 will generate alternating current) and LED 60 operates preferably with Direct Current.

Any movement of the slide in the direction of arrow 27 will decouple core 81 from 79 momentarily, thus eliminating any voltage to LED 60. However, once the slide has returned to position for firing, core 81 will again be positioned directly opposite core half 79 and power will be again be able to be induced from core 79 into core 81, causing current to be generated in the wires as previously described.

THE LIGHT EMITTING DIODE

Light emitting diode 60 and its mounting is illustrated in FIGS. 5 through 8. Light emitting diode 60 is mounted in a U-shaped bracket 90 having extensions 91 and 92 either formed or attached thereto. U-shaped bracket 90 has a channel 93 formed along its length for accommodating LED 60. A pair of contacts 94 and 95 are connected to wires 59 and 61 respectively. A pair of mounting holes 96 are used to attach U-shaped bracket 90 to semi-automatic pistol 10. A pair of angular slots 97 provide access for wires 59 and 61 from LED 60 to terminals 94 and 95 respectively through U-shaped bracket 60.

Figure 8:
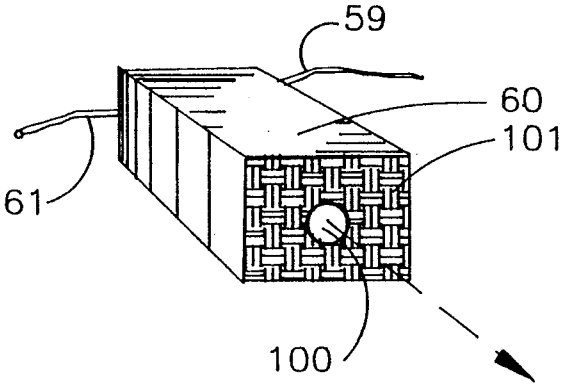
FIG. 8 is a perspective view of a modified LED illustrating a mask mounted thereon.
Figure 5:
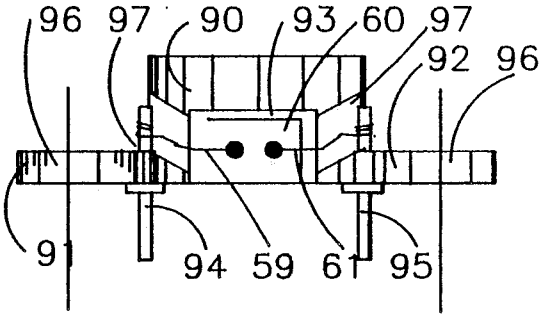
FIG. 5 is an in view of the LED bracket retaining apparatus.
Figure 7:
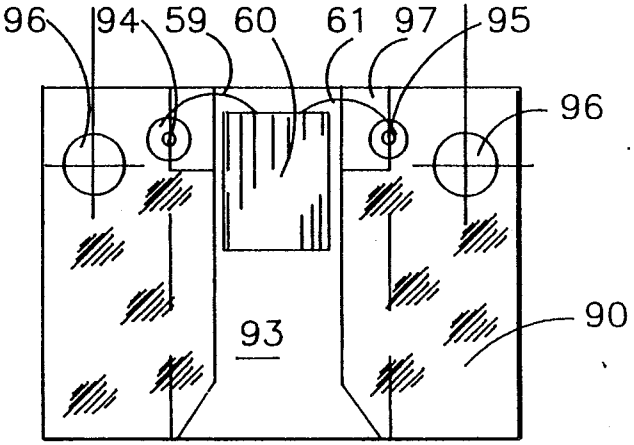
FIG. 7 is the bottom view of the apparatus illustrated in FIG. 5.

Referring to FIG. 8 LED 60 can be substantially enhanced by reducing the size of aperture 100 by forming a mask 101 which is glued to the face of LED 60. Aperture 100 can be of any configuration. That shown is a circular aperture and such aperture may be extremely small; for example, 0.001 to 0.005 inches. Mask 101 is generally affixed to LED 60 by gluing or any other similar means. LED 60 is usually prepared for mask 101 by milling off the front surface of LED 60 so that it is flat.

CONCLUSIONS

It is obvious that other housing can be used for LED 60 and still be well within the spirit and scope of this invention. It is obvious that other modifications and changes can be made in the invention as disclosed in the figures and the appended claims and such obvious modifications are well within the spirit and scope of this invention.

What I claim is:

1. A lighted gun sight for a semi-automatic pistol having a housing with an upper portion and a lower portion, a forward portion and a rearward portion, a barrel attached to said housing along its upper and forward portion, a grip attached to said housing at its lower and rearward portion, a slide slidably attached to said housing at its upper and rearward portion, said slide having an outside and being in alignment with said barrel, trigger means, and grip safety means attached to said grip for releasing said trigger means when pressure is applied to said grip safety means, and a rear sight means mounted on said slide, said lighted gun sight comprising:

(a) power means mounted in said grip;

(b) switch means mounted in said grip and connected in series with said power means for connecting or disconnecting electrically, said power means;

(c) bridge means attached along the outside of said slide and extending from said rear sight means to said grip and terminating in an end portion;

(d) electrical communication means mounted along said end portion;

(e) electrically operated light means mounted on said rear sight means and electrically connected through said bridge means to said electrical communication means;

(f) connecting means for coupling said power means through said grip and through said switch means and to said electrical communication means;

whereby when said slide is in a position to fire, and said switch means is connected to said power means said power means is connected to said electrically operated light means.

2. Apparatus as claimed in claim 1 wherein said grip safety means is coupled to said switch means in a manner to close said switch means when said grip safety means is depressed and to open said switch means when said grip safety means is not depressed.

3. Apparatus as claimed in claim 1 wherein said electrical communication means comprises a contact means mounted in said grip and a sliding contact means mounted on said edge portion of said bridge means.

4. Apparatus as claimed in claim 1 wherein said electrical communication means comprises a split transformer means having a primary circuit means mounted around core portion in said grip and a secondary circuit means mounted around a mating core portion in said bridge means.

5. Apparatus as claimed in claim 1 wherein said lighted sight means comprises:

(a) a housing having a longitudinal slot formed therein dimensioned to mount a light emitting diode;

(b) a first electrical contact means mounted through said housing and adapted to mate mechanically with a second electrical contact means attached to said rear sight means; and, (c) means for attaching said housing to said rear sight means.

6. Apparatus as claimed in claim 1 wherein said connection means comprises a resistor means for varying the voltage to said electrically operated light means; whereby the intensity of said electricity operated light means can be changed to compensate for ambient lighting conditions.

7. Apparatus as described in claim 4 wherein said power means includes a variable pulse width generating means, and a light sensitive transistor means coupled to said variable pulse width generating means in a manner to increase said pulse width in accordance with an increase in ambient light.

8. Apparatus as claimed in claim 6 wherein said resistor means includes a fixed resistor and a variable resistor, and wherein said fixed resistor protects said electrically operated light means from excessive voltage from said power means regardless of the setting of said variable resistor.

9. An interchangeable electrical light for a weapon comprising:

(a) a light emitting diode means;

(b) a mounting having a longitudinal slot there along, said slot having a portion dimensioned to accommodate said light emitting diode;

(c) electrical contact means mounted through said mounting and electrically connected to said light emitting diode means; and (d) means on said mounting for rigidly attaching said mounting to said weapon; whereby said electrical contact means will mechanically mate with other electrical contacts on said weapon.

10. Apparatus as claimed in claim 9 wherein said light emitting diode means has a flat surface for emitting light, and mask means having an aperture therethrough attached over said flat surface.

11. Apparatus as claimed in claim 10 herein said aperture is from 0.001 inches to 0.005 inches.

12. Apparatus as claimed in claim 10 wherein said aperture is configured into a non-circular shape.

13. Apparatus for transferring electrical power from the grip of a pistol having a barrel for expelling bullets, a slide for loading ammunition contained in a clip which may be inserted into said grip, and wherein said grip has an upper portion comprising:

(a) spring contact means mounted in the upper portion of said grip means;

(b) sliding contact means mounted on said slide in a location to make electrical contact with said spring contact means when said slide is in position for said pistol to be fired.

14. Apparatus as described in claim 13 wherein said sliding contact means is attached to a bridge means which is rigidly mounted to said slide, and rear sight means mounted on said slide means and electrically coupled through said bridge means to said sliding contact means.

15. Apparatus for transferring electrical power from the grip of a pistol having a slide for loading and firing said pistol, to said slide of said pistol and wherein said grip has an upper portion adjacent said slide comprising:

(a) transformer means having first and second halves, said first half, including a first core portion with a primary coil thereon and said second portion including a second core portion with a secondary coil thereon;

(b) means for mounting said first portion in said upper portion of said grip;

(c) means for mounting said second portion to said slide, said first portion and said second portion positioned opposite each other in a manner to communicate flux from said first core portion to said second core portion when said slide is in position in said pistol to be fired.

* * * * *